United States Patent [19]

Holec

[11] Patent Number: 4,757,624

[45] Date of Patent: Jul. 19, 1988

[54] CALENDAR

[76] Inventor: Lubomir Holec, 17905 Jos. Campau, Detroit, Mich. 48212

[21] Appl. No.: 30,335

[22] Filed: Mar. 26, 1987

[51] Int. Cl.[4] ..... G09D 3/04

[52] U.S. Cl. ..... 40/119; 283/2

[58] Field of Search ..... 40/119, 121, 107; 283/2

[56] References Cited

U.S. PATENT DOCUMENTS 1,169,738 1/1916 Smiley ..... 40/107

4,488,366 12/1984 Hockensmith ..... 40/119

FOREIGN PATENT DOCUMENTS 2395152 2/1979 France ..... 283/2

*Primary Examiner*—Robert Peshock

*Assistant Examiner*—Cary E. Stone

*Attorney, Agent, or Firm*—Barnes, Kisselle, Raisch, Choate, Whittemore & Hulbert

[57] ABSTRACT

A calendar comprising a plurality of sheets hinged along one edge. Each sheet comprises spaced removable postcards along the free edge thereof with one part of a month printed on one side of the sheet and another part of a month printed along the other side of the sheet. The portions of each sheet between the postcards are aligned when the sheets are folded against one another and aligned openings are provided in the portions such that the calendar can be opened and suspended with one side of one sheet being visible with a part of a month visible and the side of a succeeding sheet being visible with the remainder of the month showing and such that the postcards can be removed along weakened lines leaving the remainder of the calendar intact.

4 Claims, 2 Drawing Sheets

CALENDAR

This invention relates to calendars and particularly to calendars that comprise a plurality of sheets hinged together and arranged to be suspended on a wall.

BACKGROUND AND SUMMARY OF THE INVENTION

Among the objectives of the present invention are to provide a calendar which incorporates removable postcards; which calendar can be suspended on a wall; and which is constructed and arranged so that the postcards can be removed without interfering with the affecting the suspending on the wall.

In accordance with the invention, the calendar comprises a plurality of sheets hinged along one edge. Each sheet comprises spaced removable postcards along the free edge thereof with one part of a month printed on one side of the sheet and another part of a month printed along the other side of the sheet. The portions of each sheet between the postcards are aligned when the sheets are folded against one another and aligned openings are provided in the portions such that the calendar can be opened and suspended with one side of one sheet being visible with a part of a month visible and the side of a succeeding sheet being visible with the remainder of the month showing and such that the postcards can be removed along weakened lines leaving the remainder of the calendar intact.

DESCRIPTION

Figure 1:
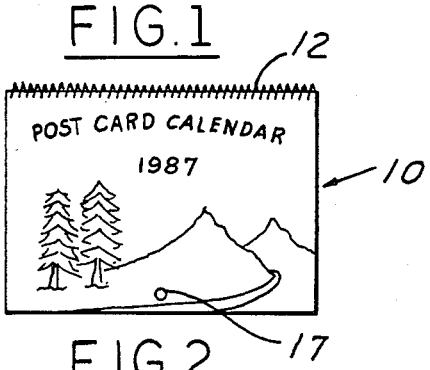
FIG. 1 is an elevational view of a calendar embodying the invention.
Figure 2:
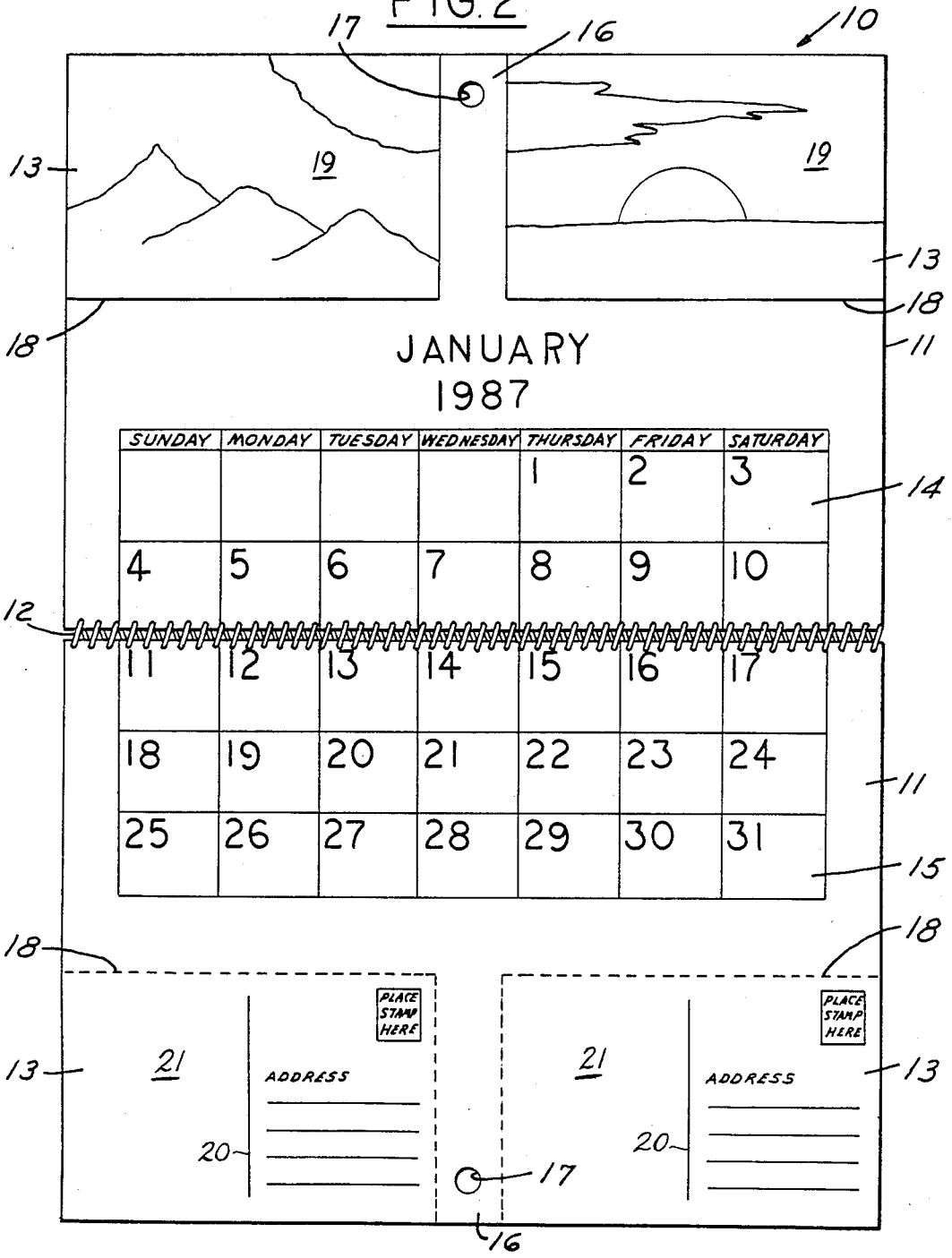
FIG. 2 is an elevational view of the calendar suspended on a wall.

Referring to the drawings, the calendar 10 embodying the invention comprises a plurality of sheets 11 hinged along one edge by hinge means 12 shown as a spiral hinge so that the sheets can be folded one on the other. The calendar may comprise a cover sheet. The present invention is concerned with the sheets bearing calendar periods such as months marked or printed thereon. Each sheet 11 comprises spaced removable postscards 13 along the free edge 14 thereof with one part of a month printed on one side of the sheet and another part of a month printed along the other side of the sheet, as at 14 and 15. The portions 16 of each sheet between the postcards 13 are aligned when the sheets 11 are folded against one another and aligned openings 17 are provided in the portions 16 such that the calendar can be opened and suspended with one side of one sheet being visible with a first part 14 of a month showing and the other side of a succeeding sheet being visible with the remainder 15 of the month showing and such that the postcards can be removed along weakened lines leaving the remainder of the calendar intact.

The postcards 13 are defined by lines 18 of demarcation which comprise weakened lines such as perforated lines or printed lines along which the postcards can be cut to remove them. Each postcard is provided with indicia 19 on one side such as pictures or printed messages and indicia 20 on the other side printed for addressing the postcard 13 and leaving space 21 for a written message.

Figure 4:
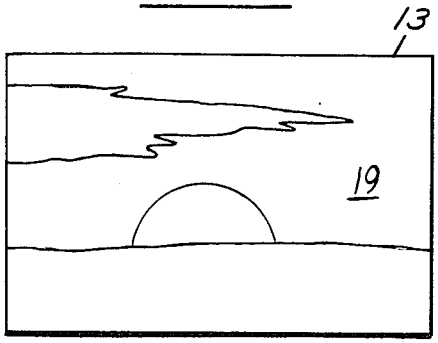
FIG. 4 is a view of a postcard removed from a sheet of the calendar.
Figure 3:
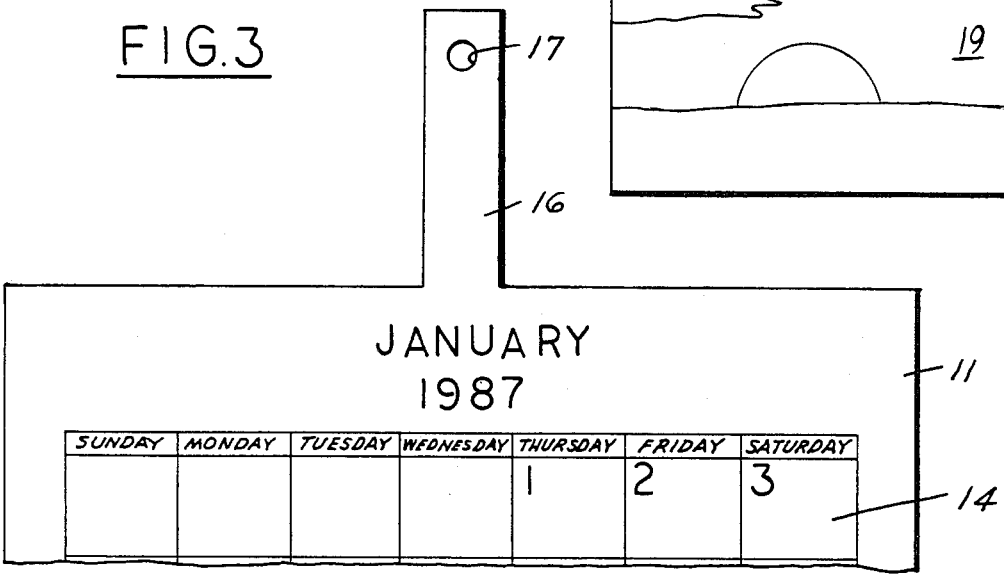
FIG. 3 is a fragmentary view of a portion of a sheet of the calendar with postcards removed.

As shown in FIGS. 3 and 4 when the post cards are removed the remaining portions 16 of the sheets 11 can still be suspended on a wall by engagement of the openings 17 on a nail or the like.

The sheets 11 are preferably made of stiff smooth paper such that the postcards will have the thickness and stiffness of quality postcards.

I claim:

1. A calendar comprising a plurality of sheets, means hinging said sheets along one edge, each sheet comprising spaced removable postcards along the free edge defined by lines of weakness, each sheet being printed with one part of a month on one side of the sheet and another part of a month along the other side of the sheet, a portion of each sheet between the postcards being aligned when the sheets are folded against one another and having an opening therein such that the openings of the aligned portions are aligned such that the calendar can be opened and suspended with one side of one sheet being visible with a part of a month showing and the succeeding sheet being visible with the remainder of the month being visible and such that the postcards can be removed along lines of demarcation leaving the remainder of the calendar intact.

2. The calendar set forth in claim 1 wherein the lines of demarcation comprise weakened lines.

3. The calendar set forth in claim 1 wherein the lines of demarcation comprise printed lines.

4. The calendar set forth in claim 1 wherein openings are circular.

* * * * *